US010066478B2

(12) United States Patent
Silva et al.

(10) Patent No.: US 10,066,478 B2
(45) Date of Patent: Sep. 4, 2018

(54) INDICATING APPARATUS, SYSTEM, AND METHOD

(71) Applicants: Zachary S. Silva, Houston, TX (US); James Smith, Manvel, TX (US); Robert O'Brien, Kelly, TX (US)

(72) Inventors: Zachary S. Silva, Houston, TX (US); James Smith, Manvel, TX (US); Robert O'Brien, Kelly, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 165 days.

(21) Appl. No.: 14/990,400

(22) Filed: Jan. 7, 2016

(65) Prior Publication Data

US 2017/0198566 A1 Jul. 13, 2017

(51) Int. Cl.
*E21B 47/09* (2012.01)
*E21B 47/024* (2006.01)

(52) U.S. Cl.
CPC ..... *E21B 47/09* (2013.01); *E21B 47/024* (2013.01)

(58) Field of Classification Search
CPC ..... E21B 47/09; E21B 23/02; E21B 23/03; E21B 23/01
See application file for complete search history.

(56) References Cited

U.S. PATENT DOCUMENTS 3,308,887 A 3/1967 Nutter
3,888,306 A * 6/1975 Wetzel ..... E21B 23/04 166/113
3,990,510 A * 11/1976 Decuir ..... E21B 23/02 166/128
4,061,389 A * 12/1977 Keller ..... E21B 23/006 175/315
4,254,983 A * 3/1981 Harris ..... E21B 31/16 294/86.21
4,979,568 A 12/1990 Spencer, III
5,092,402 A * 3/1992 Perricone ..... E21B 23/02 166/113
5,133,404 A * 7/1992 Dollison ..... E21B 23/02 166/115
5,470,860 A * 11/1995 Sanders ..... A61K 31/44 514/253.13
8,393,396 B2 3/2013 O'Brien et al.
2011/0048705 A1 3/2011 Clem et al.
2014/0144619 A1 3/2014 O'Brien
2016/0084046 A1 3/2016 Smith et al.

OTHER PUBLICATIONS

Downhole CT Tool Connections, PetroWiki, Jul. 1, 2015.

* cited by examiner

*Primary Examiner* — D. Andrews
(74) *Attorney, Agent, or Firm* — Cantor Colburn LLP

(57) ABSTRACT

An indicating tool includes a mandrel including a support, an indicator housing surrounding the mandrel, and a member movable radially with respect to the housing. The mandrel is movable longitudinally with respect to the indicator housing, and the indicator housing is at least substantially rotationally locked with respect to the mandrel. The member is engageable with an inner profile of an outer tubular in which the indicating tool is employed, and the member has a substantially helical side. The member is movable radially inward towards the mandrel when the support is longitudinally displaced from the member, and the member is blocked from movement radially inwards when the support is longitudinally aligned with the member.

23 Claims, 13 Drawing Sheets

INDICATING APPARATUS, SYSTEM, AND METHOD

BACKGROUND

In the drilling and completion industry, the formation of boreholes for the purpose of production or injection of fluid is common. Hydrocarbons such as oil and gas can be recovered from the subterranean formation using the boreholes.

With the advances of downhole completion and well monitoring methods, rotationally aligning service strings are beginning to see a growing number of applications for their use. Current generation rotationally aligned equipment, in the form of well monitoring wet connects, are commonly positioned at the top of a lower completion to allow a monitor from the lower completion to be linked to surface equipment. However, these rotational aligned connections are limited to a single point in the tool string. Additionally, downhole completion frac pack methods are limited to linear alignment only of a service string to an outer string in current generation completion systems. This introduces difficulties in ways to control erosive flow paths and implement optimal alignment of tool strings to ensure durability for the applicable frac tools. Multizone completions are equally limited in the inability to rotationally align a frac tool with each frac sleeve over the course of several zones.

The art would be receptive to alternative and improved methods and apparatus for indicating location of a string downhole.

BRIEF DESCRIPTION

An indicating tool includes a mandrel including a support, an indicator housing surrounding the mandrel, and a member movable radially with respect to the housing. The mandrel is movable longitudinally with respect to the indicator housing, and the indicator housing is at least substantially rotationally locked with respect to the mandrel. The member is engageable with an inner profile of an outer tubular in which the indicating tool is employed, and the member has a substantially helical side. The member is movable radially inward towards the mandrel when the support is longitudinally displaced from the member, and the member is blocked from movement radially inwards when the support is longitudinally aligned with the member.

A completion system includes an indicating tool and an outer tubular. The indicating tool includes a mandrel including a support, an indicator housing surrounding the mandrel, and a member movable radially with respect to the housing. The mandrel is movable longitudinally with respect to the indicator housing, and the indicator housing is at least substantially rotationally locked with respect to the mandrel. The member is engageable with an inner profile of an outer tubular in which the indicating tool is employed, and the member has a substantially helical side. The member is movable radially inward towards the mandrel when the support is longitudinally displaced from the member, and the member is blocked from movement radially inwards when the support is longitudinally aligned with the member. The inner profile of the outer tubular has a helical profile face.

A completion system includes an outer tubular having an inner profile, the inner profile having a helical profile face, and an indicating tool movable within the outer tubular. The indicating tool includes a mandrel including a support; an indicator housing surrounding the mandrel, the mandrel movable longitudinally with respect to the indicator housing, and the indicator housing at least substantially rotationally locked with respect to the mandrel; and a member movable radially with respect to the housing, the member engageable with the inner profile of the outer tubular, the member having a substantially helical side. Engagement of the side of the member with the helical profile face of the inner profile of the outer tubular imparts rotation to the indicating tool during longitudinal movement of the tool within the outer tubular.

A method of rotationally locating an inner string within an outer tubular, the method including running the inner string through the outer tubular towards an inner profile of the outer tubular, the inner string including an indicating tool, the indicating tool including a mandrel having a support, an indicator housing surrounding the mandrel, the mandrel movable longitudinally with respect to the indicator housing, the indicator housing at least substantially rotationally locked with respect to the mandrel, and a member movable radially with respect to the housing, the member having a substantially helical side; engaging the helical side of the member with the inner profile of the outer tubular; and, rotating the inner string with respect to the outer tubular by camming the helical side of the member along a helical profile face of the inner profile.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
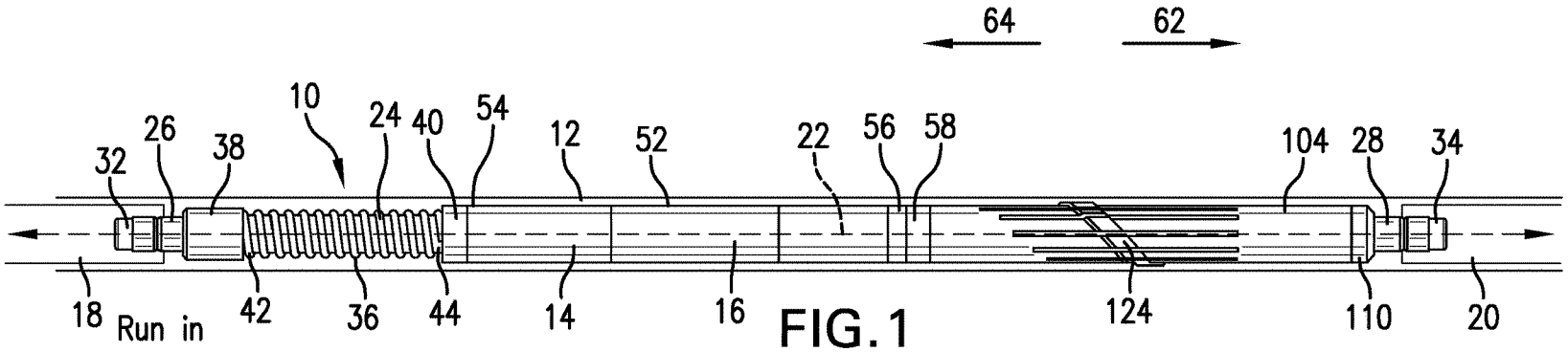
FIG. 1 schematically depicts an embodiment of a system including a rotationally alignable indicating tool.

A detailed description of one or more embodiments of the disclosed apparatus and method are presented herein by way of exemplification and not limitation with reference to the Figures.

With reference now to the figures, embodiments of an indicating system 10 are shown. The indicating system 10 includes, in part, an outer tubular 12 and an inner string 14 movable within the outer tubular 12. The inner string 14 includes an indicating tool 16, and may further include a first unit 18 and a second unit 20 attached to first and second ends, respectively, of the indicating tool 16. The indicating tool 16 further includes a longitudinal axis 22, which may be substantially the same as a longitudinal axis of the outer tubular 12.

Figure 2:
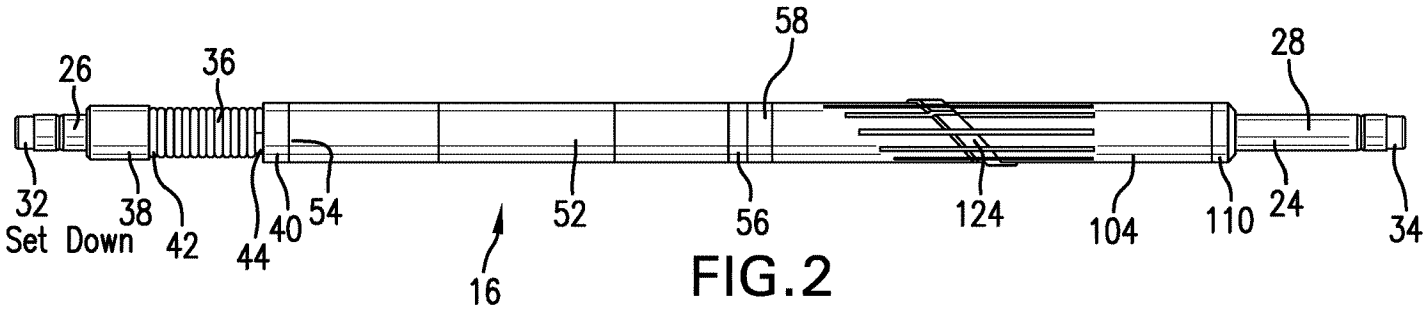
FIG. 2 depicts a side view of the indicating tool of FIG. 1 in a set down condition.
Figure 3:
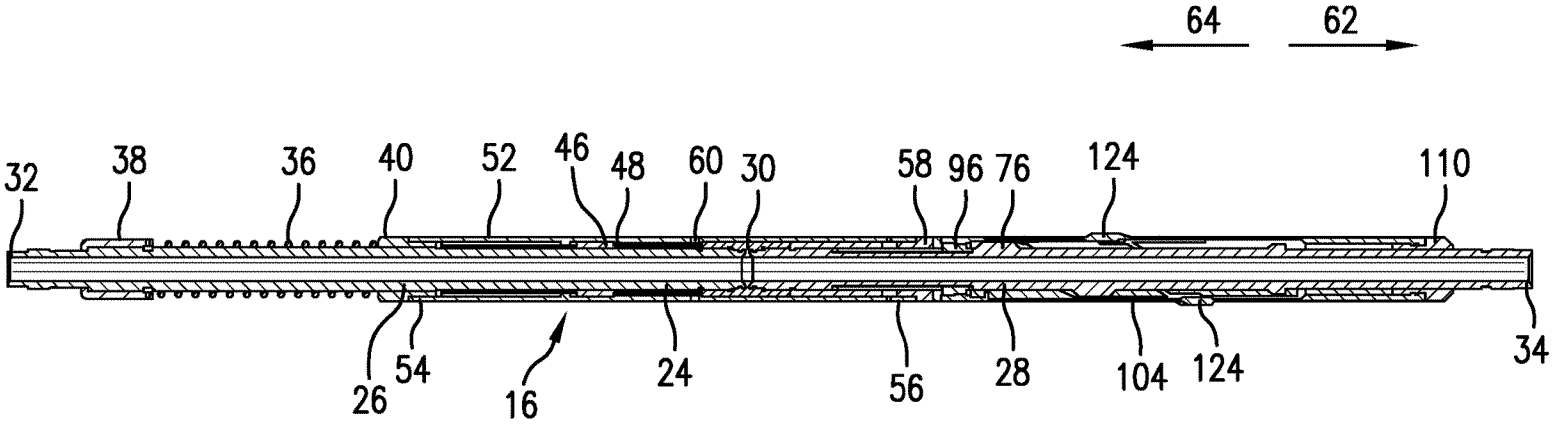
FIG. 3 depicts a sectional view of the indicating tool in a run-in condition.
Figure 4:
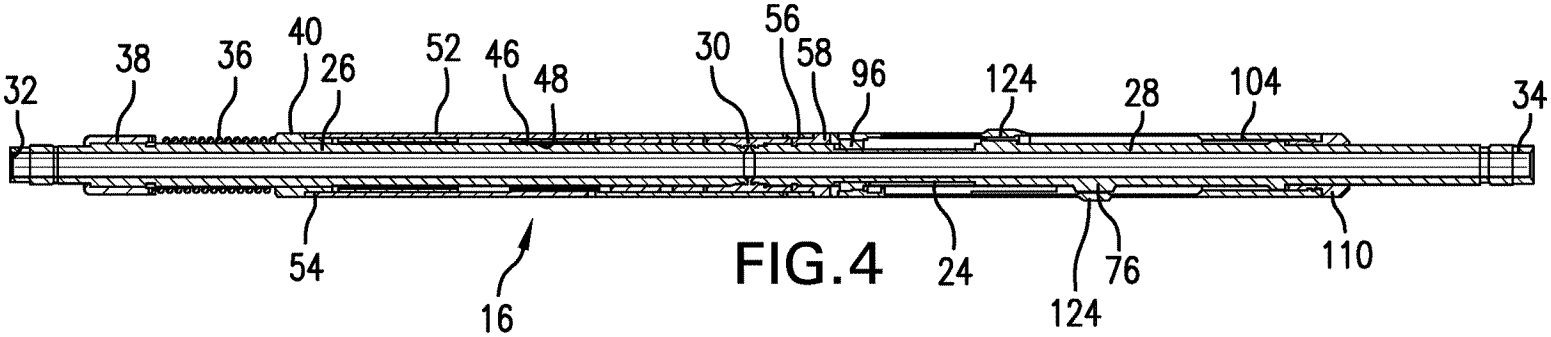
FIG. 4 depicts a sectional view of the indicating tool in a set-down condition.
Figure 5:
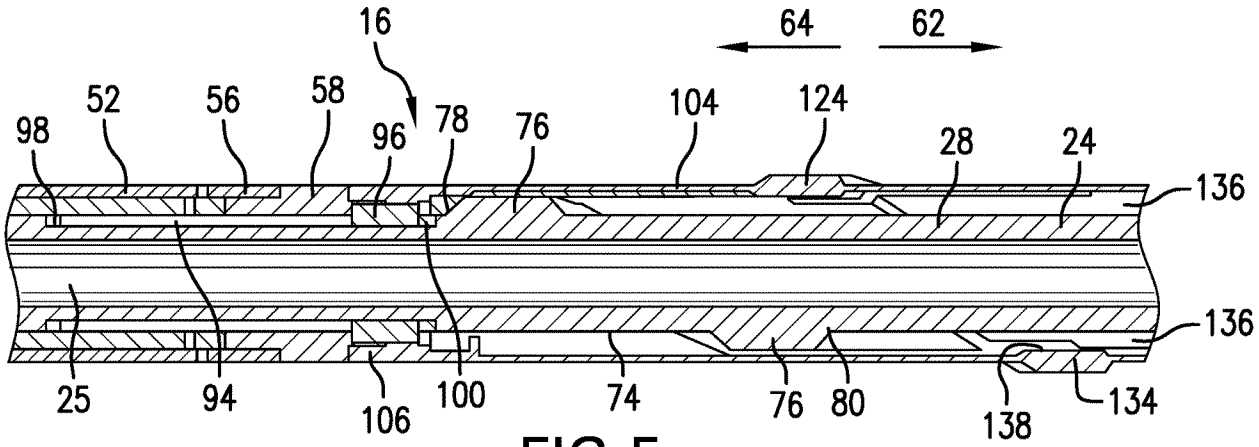
FIG. 5 depicts a sectional view of a portion of the indicating tool in a run-in condition.
Figure 6:
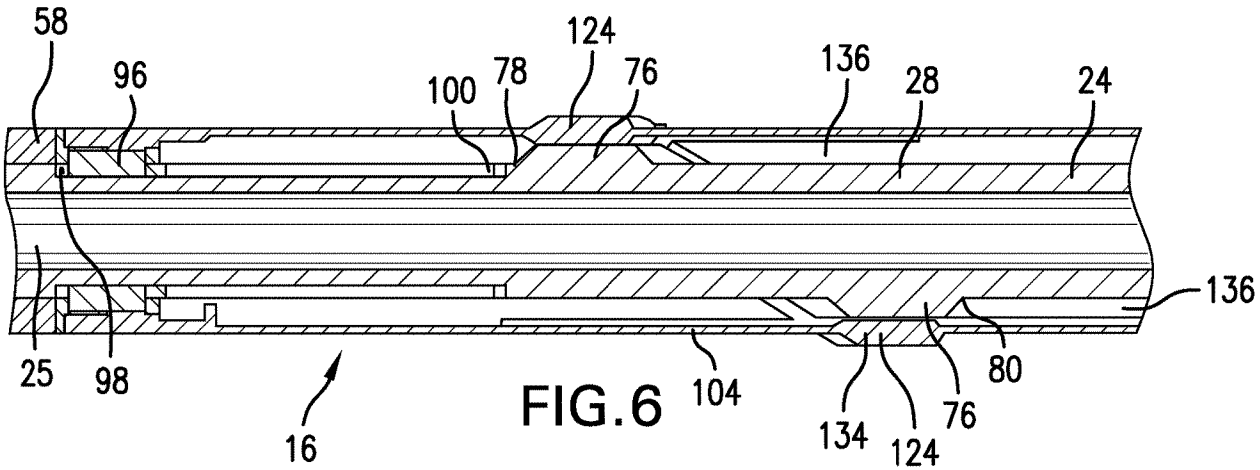
FIG. 6 depicts a sectional view of a portion of the indicating tool in a set-down condition.

FIGS. 1, 3, and 5 show the tool 16 of the system 10 in a run-in condition, and FIGS. 2, 4, and 6 show the tool 16 of the system 10 in a set down condition. In the run-in condition, the tool 16 can be passed through the outer tubular 12 of the system 10. The tool 16 can be further adjusted such that inner profiles of the outer tubular 12 can be bypassed so as to move the inner string 14 to a desired location, such as an inner profile of the outer tubular 12 in a different zone. The tool 16 can be selectively indexed to the set down condition, such that the tool 16, and thus the inner string 14, is prevented from bypassing an inner profile of the outer tubular 12.

The indicating tool 16 includes an inner mandrel 24. The inner mandrel 24 includes, in one embodiment, a bore 25 serving as a flow path for fluids or passage for other downhole equipment. In one embodiment, the mandrel 24 includes an upper or first mandrel portion 26 and a lower or second mandrel portion 28. The first and second mandrel portions 26, 28 are connected by a mandrel connector 30 (FIGS. 3 and 4). Alternatively, the first and second mandrel portions 26, 28 are integrally connected. In yet another alternative embodiment, the mandrel 24 is formed of more than two mandrel portions connected together to form the mandrel 24. A first end 32 of the mandrel 24 (corresponding to a first end of the indicating tool 16) is provided with a first connection feature configured to connect the indicating tool 16 to the first unit 18, such as, but not limited to a crossover tool. Also, there may be one or more additional connecting units between the tool 16 and the first unit 18. A second end 34 of the mandrel 24 is provided with a second connection feature configured to connect the tool 16 to the second unit 20, such as, but not limited to another downhole tool. Together, the tool 16 and the first and second units 18, 20 and any additional joints form the string 14 for the system 10, and the system 10 may be inclusive of both the string 14 and related components within the outer tubular 12.

The mandrel 24, and in particular the first mandrel portion 26, supports a spring 36 thereon. The spring 36 is longitudinally constrained by an upper or first spring retainer 38 and a lower or second spring retainer 40. That is, the spring 36 includes a first end 42 in abutment with the first spring retainer 38 and a second end 44 in abutment with the second spring retainer 40. The first spring retainer 38 is fixed with respect to the mandrel 24, while the mandrel 24 is longitudinally movable with respect to the second spring retainer 40.

Figure 7:
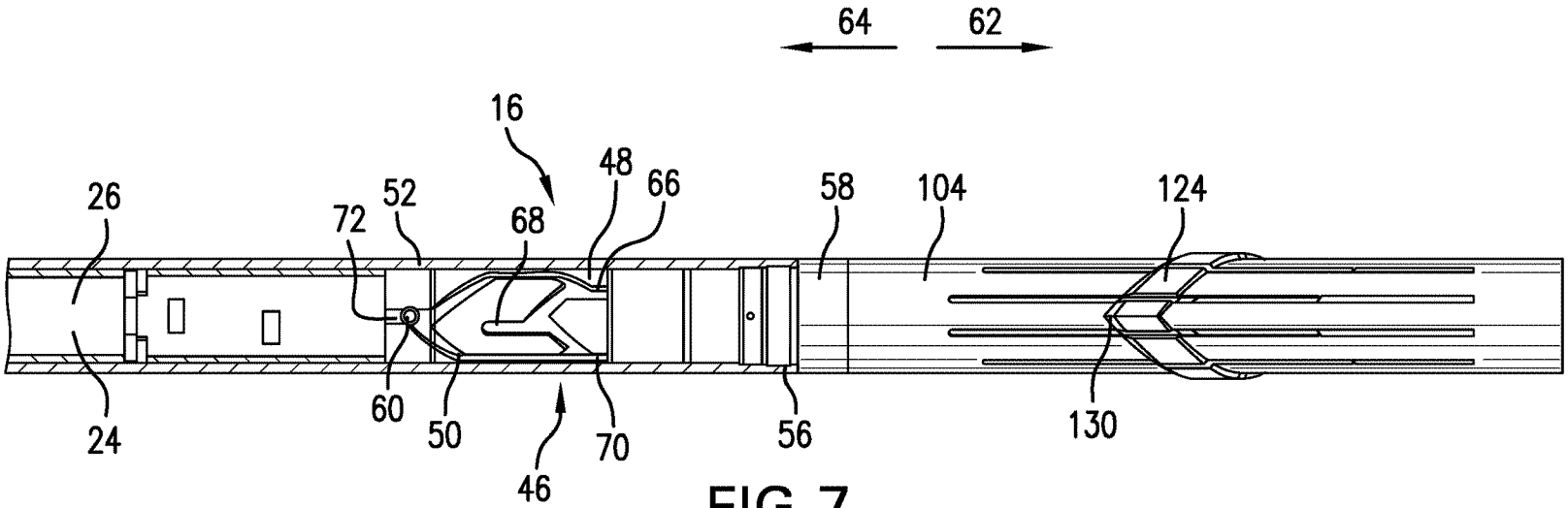
FIG. 7 depicts a portion of the indicating tool with a housing shown in phantom to reveal an embodiment of an indexing arrangement.

The mandrel 24, and in particular the first mandrel portion 26, further supports an indexing arrangement 46 thereon, as shown in FIGS. 3, 4, and 7. The indexing arrangement 46 includes an orientation sleeve 48. The orientation sleeve 48 includes an indexing slot 50, such as shown in FIG. 7. An indexing housing 52 surrounds the orientation sleeve 48 and is connected at a first end 54 to the second spring retainer 40 and at a second end 56 to a connector sub 58. The indexing housing 52 surrounds the mandrel connector 30 and a portion of the second mandrel portion 28. The indexing housing 52 further supports a lug 60 movable within the indexing slot 50. That is, as the mandrel 24 moves longitudinally with respect to the indexing housing 52, the lug 60 follows the indexing slot 50. For example, when the mandrel 24 is moved against the bias of the spring in direction 62, the lug 60 is moved through the slot 50 from a pre-snap position 66 to a snap position 68. From the snap position 68, movement of the mandrel 24 in direction 64 places the lug 60 to the pre-locate position 70. Further movement of the mandrel 24 in direction 62 then places the lug 60 in the locate position 72 of the indexing slot 50. Moving the mandrel 24 in direction 64 places the lug 60 back in the pre-snap position 66. Thus, as the mandrel 24 is moved longitudinally about the longitudinal axis 22 in the first direction 62 (such as a downhole direction) and second direction 64 (such as an uphole direction), the lug 60 is made to follow a cyclic path of the indexing slot 50.

Figure 8:
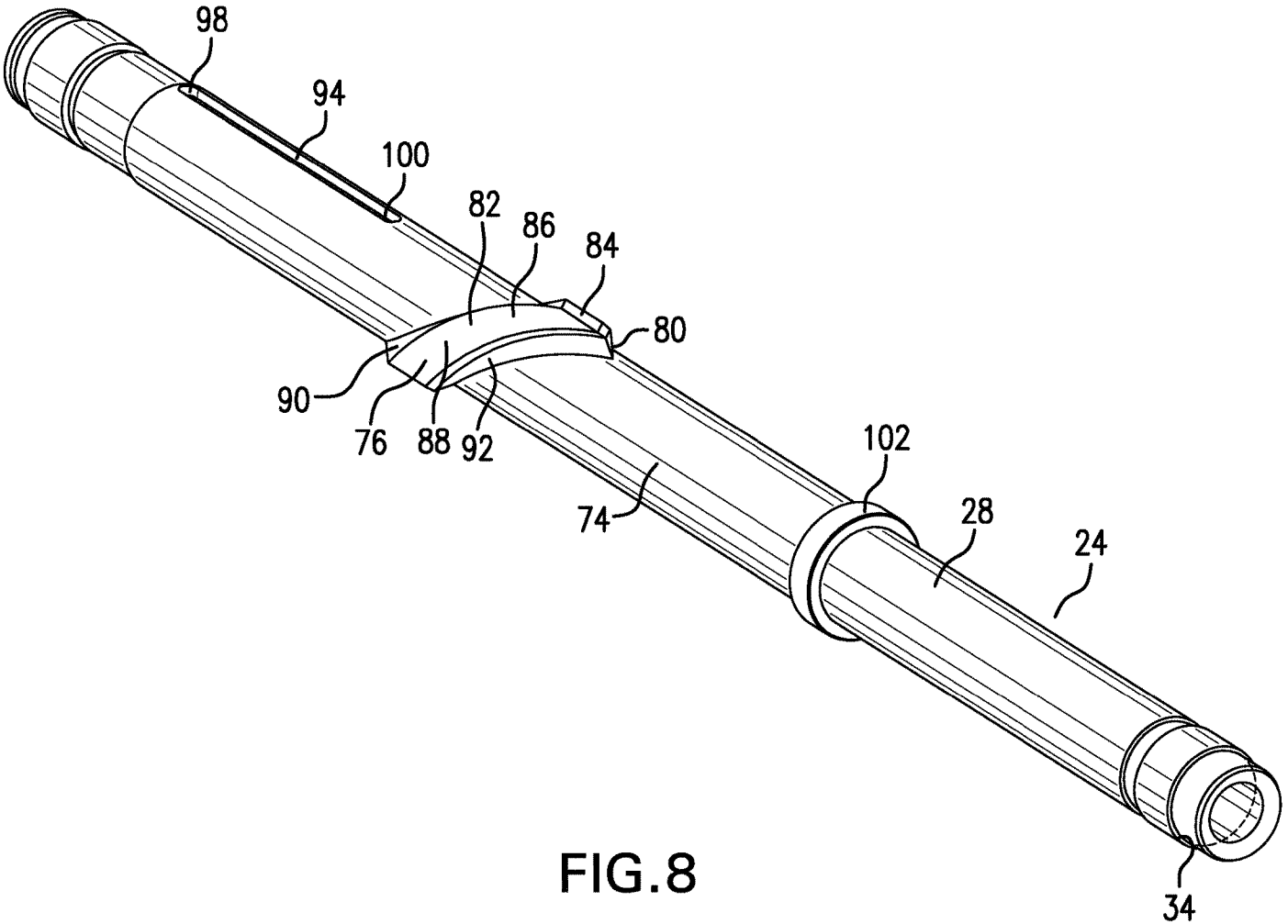
FIG. 8 depicts a perspective view of an embodiment of a portion of a mandrel for the indicating tool.

The mandrel 24, and in particular the second mandrel portion 28, as further shown in FIG. 8, includes an outer surface 74 having a helical support 76. The helical support 76 is not inwardly radially movable, and protrudes radially outwardly from the outer surface 74. The helical support 76 includes a first end 78 (FIGS. 5 and 6) and a second end 80, and further includes a first helical support portion 82 and a second helical support portion 84. Each of the first and second helical support portions 82, 84 include a half turn of a helix. That is, each of the first and second helical support portions 82, 84 extend helically for a half turn of a helix, with the one of the first and second helical support portions 82, 84 extending in a clockwise direction about the longitudinal axis 22, and the other of the first and second helical support portions 82, 84 extending in a counter-clockwise direction about the longitudinal axis 22. A first end of the first helical support portion 82 and a first end of the second helical support portion 84 meet at the first end 78 of the helical support 76, and a second end of the first helical support portion 82 and a second end of the second helical support portion 84 meet at the second end 80 of the helical support 76. Thus, the first and second helical support portions 82, 84 occupy a same longitudinal section of the mandrel 24, but occupy distinct radial sections of the same longitudinal section of the mandrel 24. The first and second helical support portions 82, 84 each include a helical protrusion 86 having a radially outward facing surface 88 and helically extending first and second sides 90, 92. Side 90 faces in direction 64, such as an uphole direction, and side 92 faces in direction 62, such as a downhole direction, when in use. The mandrel 24 further includes a longitudinally extending keyway 94 configured for receiving a key 96 (key 96 shown in FIGS. 5, 6). The keyway 94 extends from a first end 98 to a second end 100. The mandrel 24 further includes a radially protruding stop shoulder 102.

Figure 9:
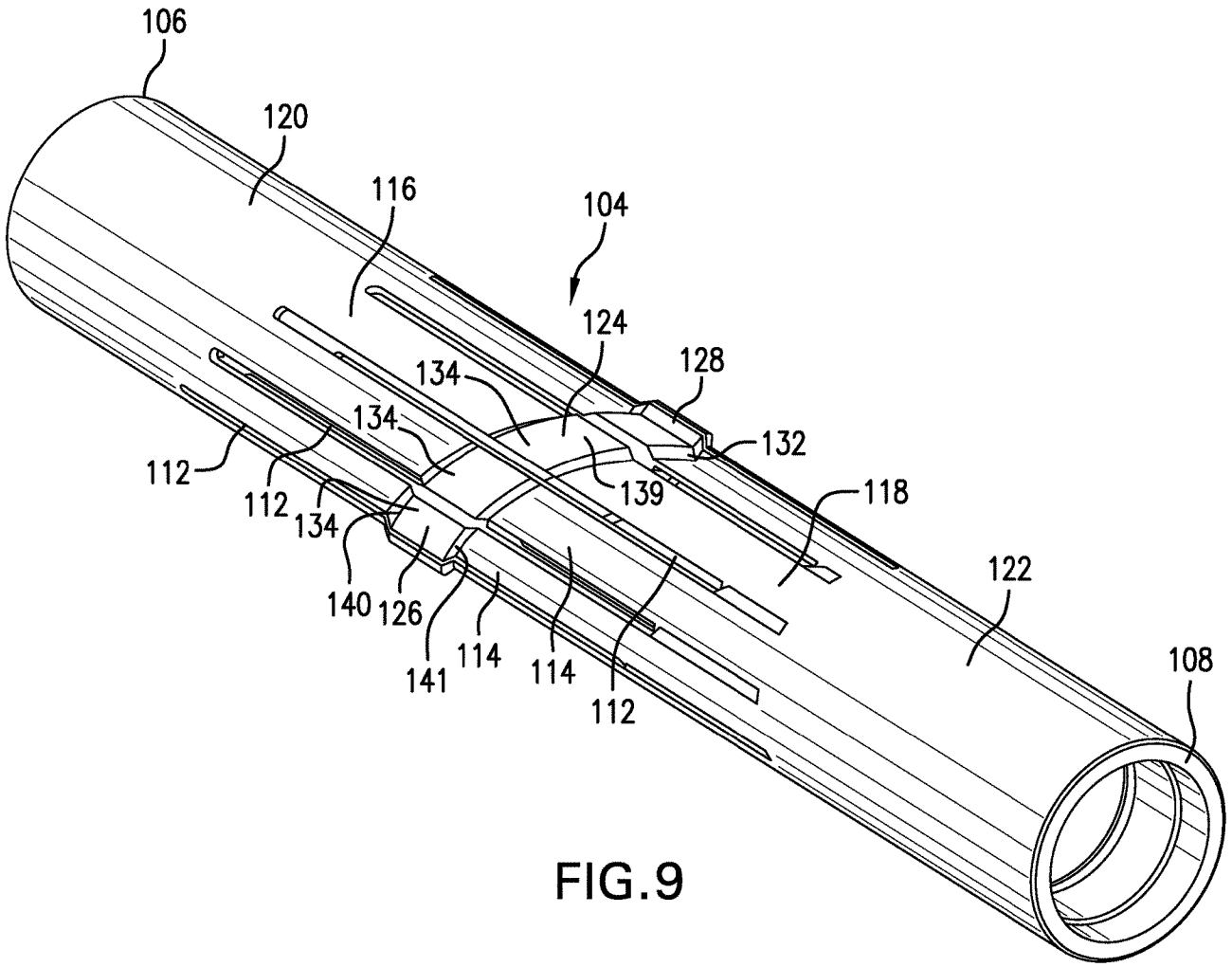
FIG. 9 depicts a perspective view of an embodiment of a collet for indicating tool.

In some embodiments of the system 10 and indicating tool 16, surrounding the second mandrel portion 28 of the mandrel 24 is a collet 104, shown separately in FIG. 9. The collet 104 serves as an indicator housing. A first end 106 of the collet 104 is connected to the connector sub 58, and a second end 108 of the collet 104 is connected to a collet retainer 110. The collet 104 includes a plurality of radially spaced longitudinal slots 112. Between adjacent slots 112, a plurality of radially deflectable segments 114 extend longitudinally. The slots 112 enable the segments 114 to be deflected radially inwardly. Each segment 114 includes a first end 116 and a second end 118 connected respectively to first and second non-radially deflectable portions 120, 122 of the collet 104. The non-radially deflectable portions 120, 122 of the collet do not contain the slots 112, and thus are radially solid and not collapsible inwardly as are the segments 114. The set of segments 114 together provide a helical member 124 including a first helical member portion 126 and a second helical member portion 128. Each of the first and second helical member portions 126, 128 include a half turn of a helix. A first end of the first helical member portion 126 and a first end of the second helical member portion 128 meet at a first end 130 (FIG. 7) of the helical member 124, and a second end of the first helical member portion 126 and a second end of the second helical member portion 128 meet at the second end 132 of the helical member 124. Thus, the first and second helical member portions 126, 128 occupy a same longitudinal section of the collet 104, but occupy distinct radial sections of the same longitudinal section of the collet 104. The first and second helical member portions 126, 128 are each divided into a plurality of helical nubs 134 due to the slots 112 that are interposed between adjacent segments 114. As can best be seen in a cross-section of the collet 104, such as in FIGS. 5 and 6, each helical nub 134 may extend both radially inwardly and radially outwardly with respect to a thickness of first and second ends 116, 118 of the segments 114. The helical member 124 further includes an outer surface 139. In a biased condition of the collet 104, an outer diameter of the helical member 124 at the outer surface 139 is greater than an outer diameter of the collet 104 at the first and second portions 120, 122. However, as the segments 114 are arranged to deflect radially inwardly, the outer diameter of the collet 104 at the helical member 124 may not always be greater than the outer diameter of the collet 104 at the first and second portions 120, 122. The helical member 124 further includes first and second sides 140, 141, with the first side 140 facing in direction 64, such as an uphole direction, and the second side 141 facing in direction 62, such as a downhole direction.

As best seen in FIGS. 5 and 6, the engagement between the mandrel 24 and the collet 104 during run-in (FIG. 5) and set-down (FIG. 6) conditions are shown. In the run-in condition, the key 96, which may be attached to one or both of the connector sub 58 and first end 106 of the collet 104, is disposed at the second end 100 of the keyway 94. Thus, the helical member 124 of the collet 104 is longitudinally displaced from the rotational support 76 of the mandrel 24 at any given radial location of the helical member 124. With additional reference to FIG. 7, the lug 60 may be placed in the pre-snap position 66 during run-in. If the helical member 124 encounters an inner profile of the outer tubular 12, the mandrel 24 may be pushed relative to the collet 104 such that the lug is placed in the snap position 68. As the support 76 of the mandrel 24 is still not located within the member 124, the member 124 remains unsupported by the support 76, and further movement in the direction 62 will allow the member 124 to flex radially inwardly as needed due to an annular space 136 between an inner surface 138 of the nubs 134 and the outer surface 74 of the mandrel 24. Thus, the inner string 14 may move past the inner profile of the outer tubular 12. If, however, it is desired to locate upon the inner profile, the mandrel 24 may be moved in direction 64 to place the lug 60 within the pre-locate position 70 of the indexing arrangement 46. Then, movement of the mandrel 24 in direction 62 places the lug 60 in the locate position 72 (corresponding to the set-down position shown in FIG. 6). Also, movement of the mandrel 24 in direction 62 shifts the keyway 94 to place the key 96 at the second end 98 of the keyway 94, and further aligns the support 76 with the member 124 such that the member 124 is blocked from inward radial movement. In this set down condition, the helical member 124 is engageable with the inner profile of the outer tubular 12, and the inner string 14 cannot move longitudinally past the inner profile of the outer tubular 12 because the helical member 124 cannot deflect radially inward.

With reference now to FIGS. 10 to 13, movement of the indicating tool 16, and in particular the collet 104, within the outer tubular 12 is demonstrated. The outer tubular 12 includes an inner profile 142 recessed into the inner surface 144 of the outer tubular 12. That is, an inner radius of the outer tubular 12 at the inner profile 142 is greater than an inner radius of the outer tubular 12 at the inner surface 144. The inner radius of the outer tubular 12 at the inner surface 144 may be smaller than an outer radius of the collet 104 at the helical member 124. Because the helical member 124 is inwardly radially deflectable when not supported by support 76, the inner string 14 is able to pass through the outer tubular 12. When encountering the inner profile 142, the helical member 124 will move radially outwardly into the inner profile 142. At this point, an operator can choose to move longitudinally past the inner profile 142, or may choose to move the mandrel 24 with respect to the collet 104 to support the helical member 124 with the support 76 as previously described.

Figure 10:
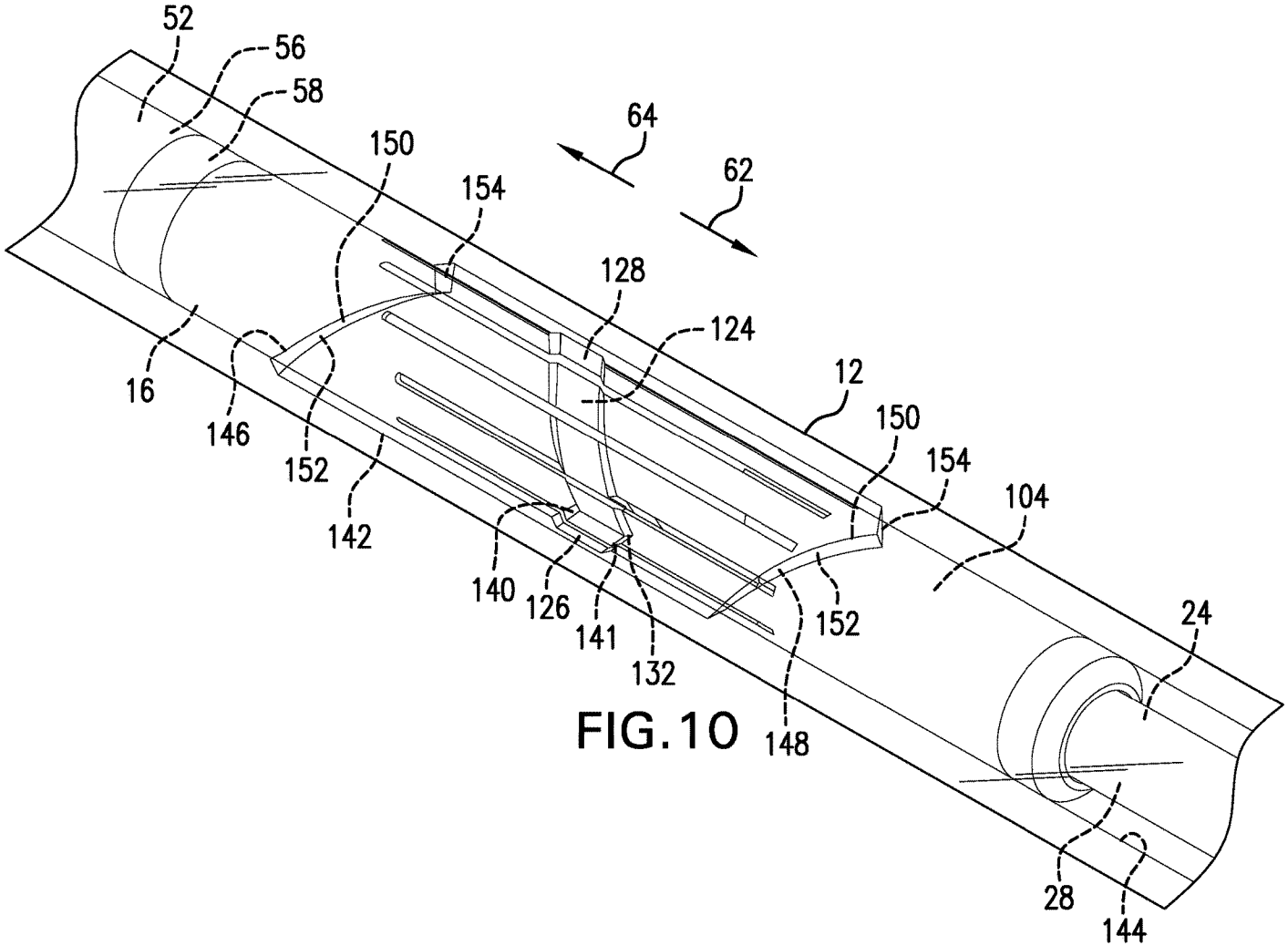
FIGS. 10-13 depict the indicating tool at various stages of movement an outer tubular.
Figure 11:
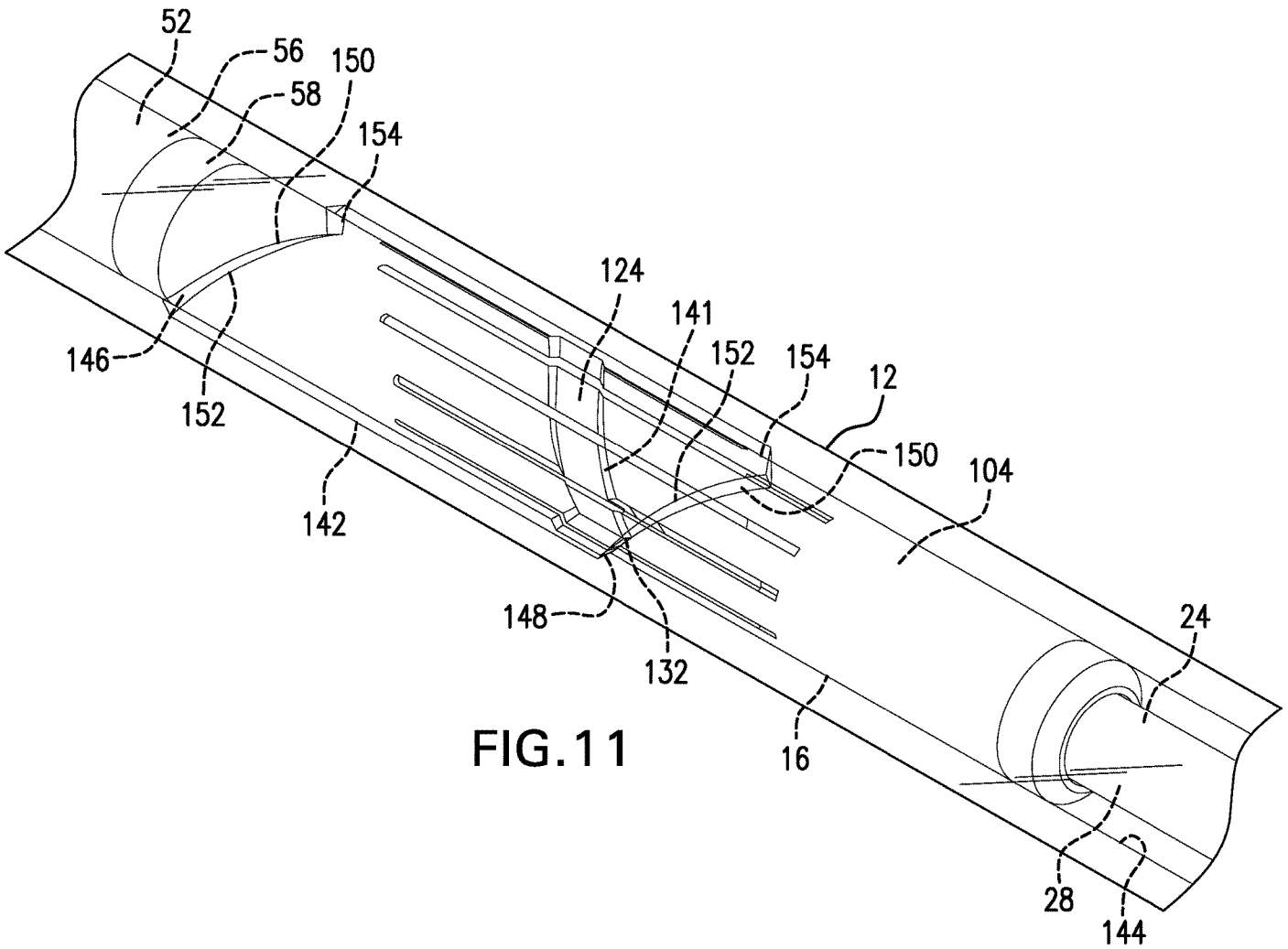
Figure 12:
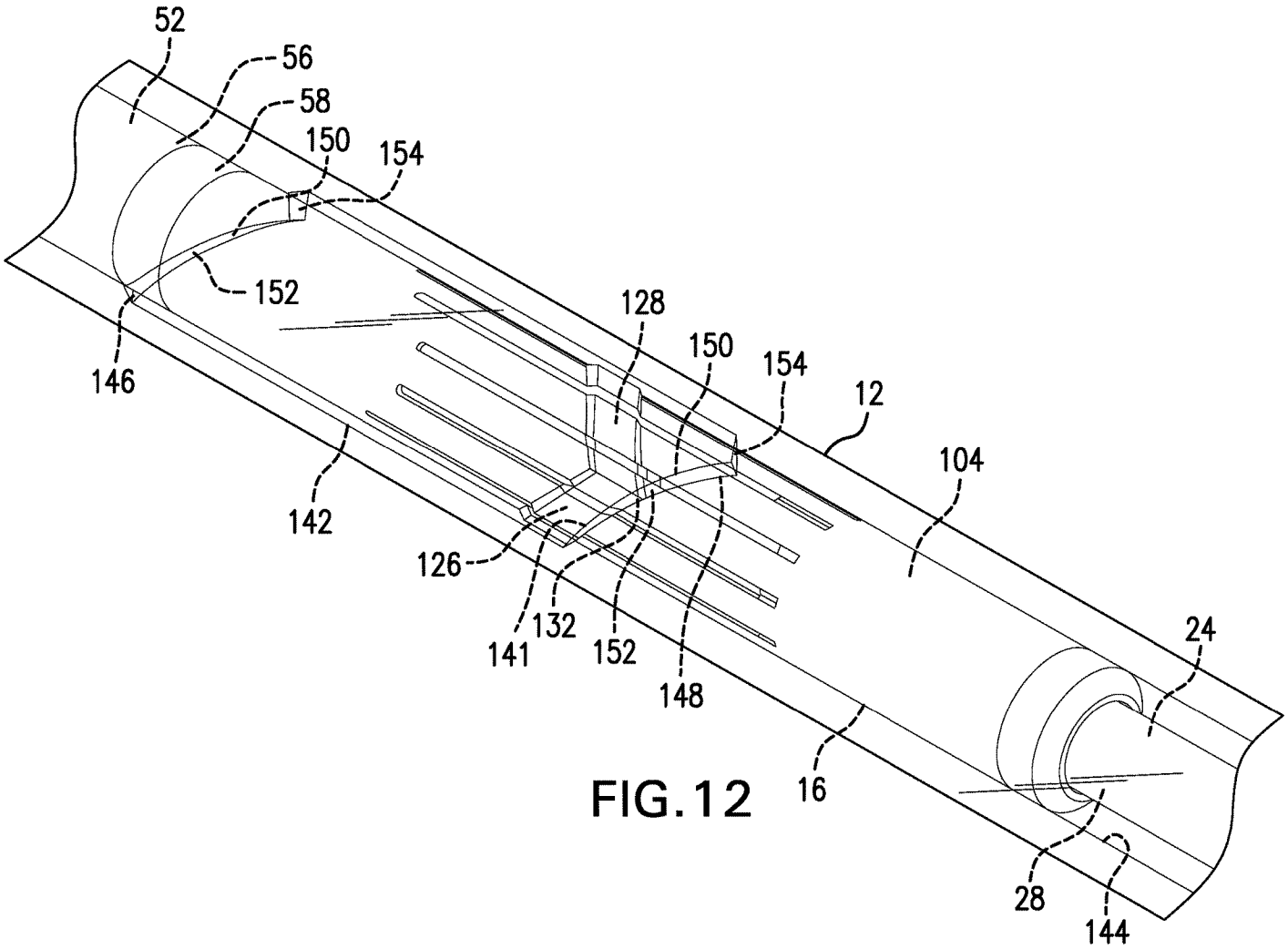
Figure 13:
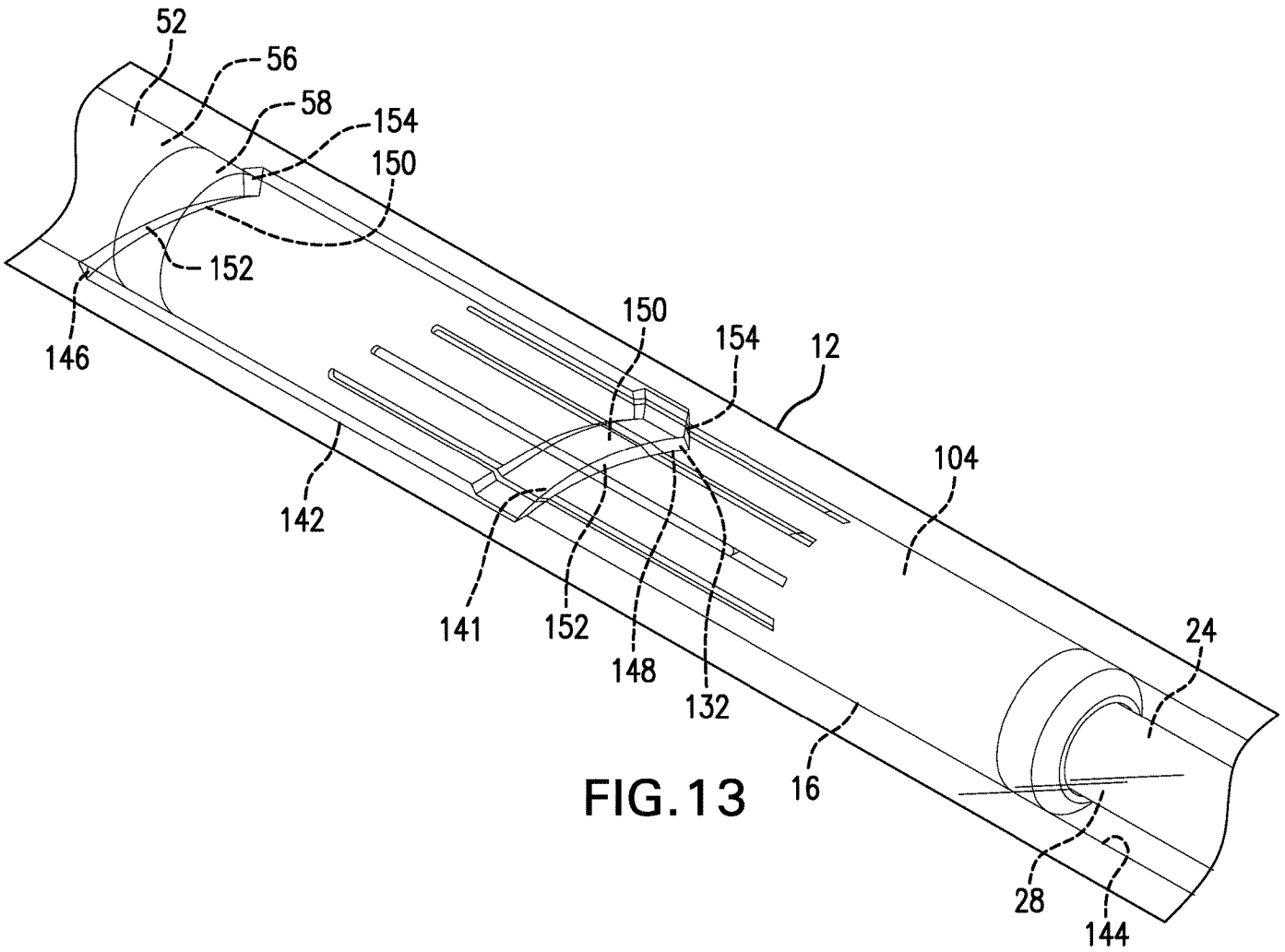

The inner profile 142 includes a first end 146 and a second end 148. In one embodiment, each of the first and second ends 146, 148 includes a helical profile face 150 with first and second helical profile face sections 152, 154. The first and second helical profile face sections 152, 154 each extend a half helical turn in opposite rotational directions from the first end 146 to the second end 148. For illustrative purposes, FIGS. 10-13 depict the indicating tool 16 traveling into the inner profile 142 in direction 62 and at a non-aligned angle. FIG. 10 shows the helical member 124 of the collet 104 snapped out into the inner profile 142, and the indicating tool 16 continues to move in direction 62. In FIG. 11, the helical member 124 of the collet makes contact with the profile face 150 at the first helical profile face section 152 of the inner profile 142. Note that, again for illustrative purposes, only one "side" of the helical member 124 of the collet 104, in this case the second side 141 of the first helical member portion 126, is in contact with the profile face 150 because the tool 16 is not rotationally aligned with the inner profile 142 and outer tubular 12. As downward movement of the tool continues in direction 62, torque is imparted on the tool 16 and inner string 14 through the interaction between the helical member 124 of the collet 104 and the first helical profile face section 152 of the inner profile 142, thus the tool 16 begins to rotate along the first helical profile face section 152 of the inner profile 142. Since the collet 104 is rotationally locked with respect to the mandrel 24, the tool 16 and inner string 14 will correspondingly rotate. Motion in direction 62 and rotation of the tool 16 and string 14 continue as shown in FIG. 12, with the second side 141 camming along the first profile face section 152, and with the second end 132 of the helical member 124 approaching the intersection of the first helical profile face section 152 and the second helical profile face section 154. As shown in FIG. 13, the collet 104 and tool 16 (and inner string 14) are rotationally aligned with the helical profile face 150, such that the second side 141 of the helical member 124 is engaged with both the first and second helical profile face sections 152, and the second end 132 of the helical member 124 is disposed at the intersection of the first and second helical profile face sections 152, 154. Thus, the tool 16 and inner string 14 have now become both axially and rotationally aligned with the outer tubular 12 to a known location. Note that the second side 141 of both the first and second helical member portions 126, 128 are in contact with the helical profile face 150 at the second end 148 of the inner profile 142, and that additional application of downward force in direction 62 is driven into the helical collet 104 in an effort to uniformly radially collapse towards the mandrel 24. If the tool 16 was in the "pass through" configuration (with lug 60 at the snap position 68), the collet 104 would snap through this profile 142 after the rotational alignment occurred. However, if the operator has selected to move the mandrel 24 to the set-down position, corresponding to placement of the lug 60 within the locate position 72, and alignment of the support 76 with the helical member 124, then the helical member 124 will remain seated within the inner profile 142 as shown in FIG. 13 due to the inability to move radially inward to snap through the profile 142, thus achieving a set-down indicating position.

While FIGS. 10-13 describe movement of the inner string 14 within the outer tubular 12 in direction 62, the motion could be reversed and the helical member 124 can snap into inner profile 142 while traveling in direction 64. In this case the first side 140 of the helical member 124 will engage with the first and second helical profile face sections 152, 154 at the first end 146 of the inner profile 142, thus rotationally and longitudinally aligning the indicating tool 16 and inner string 14 at a known location with respect to the outer tubular 12. Also as previously described, the mandrel 24 may be moved with respect to the collet 104 to either block the helical member 124 from inward radial movement, or allow inward radial movement, as selected by an operator.

Figure 14:
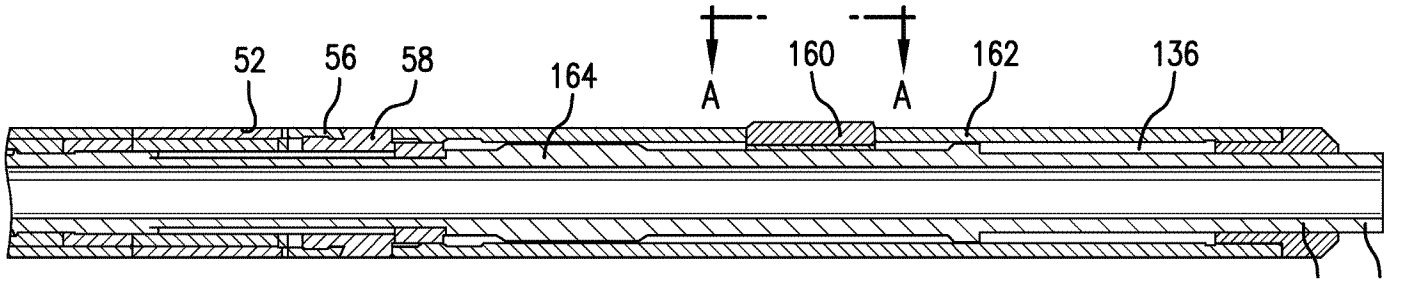
FIGS. 14-16 depict a sectional view of a portion of an embodiment of the indicating tool having a dog.
Figure 15:
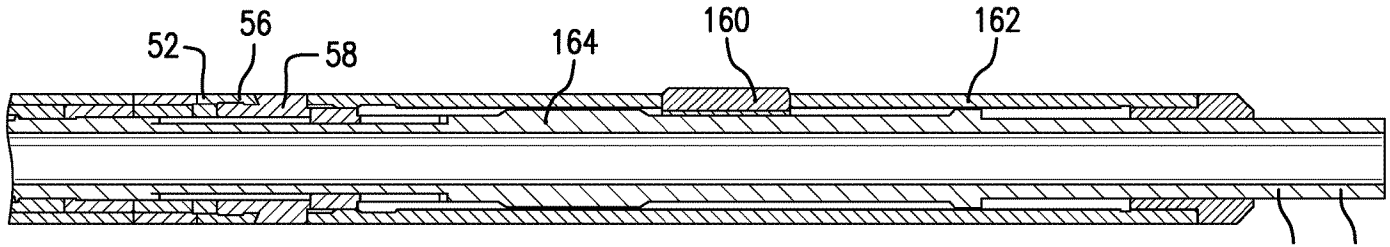
Figure 16:
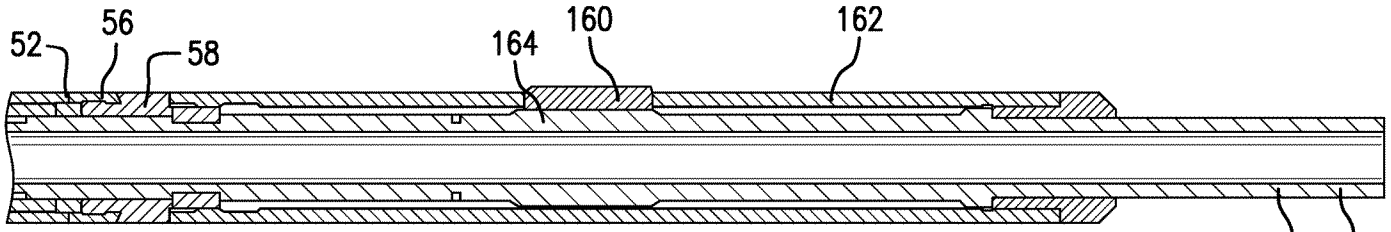
Figure 17:
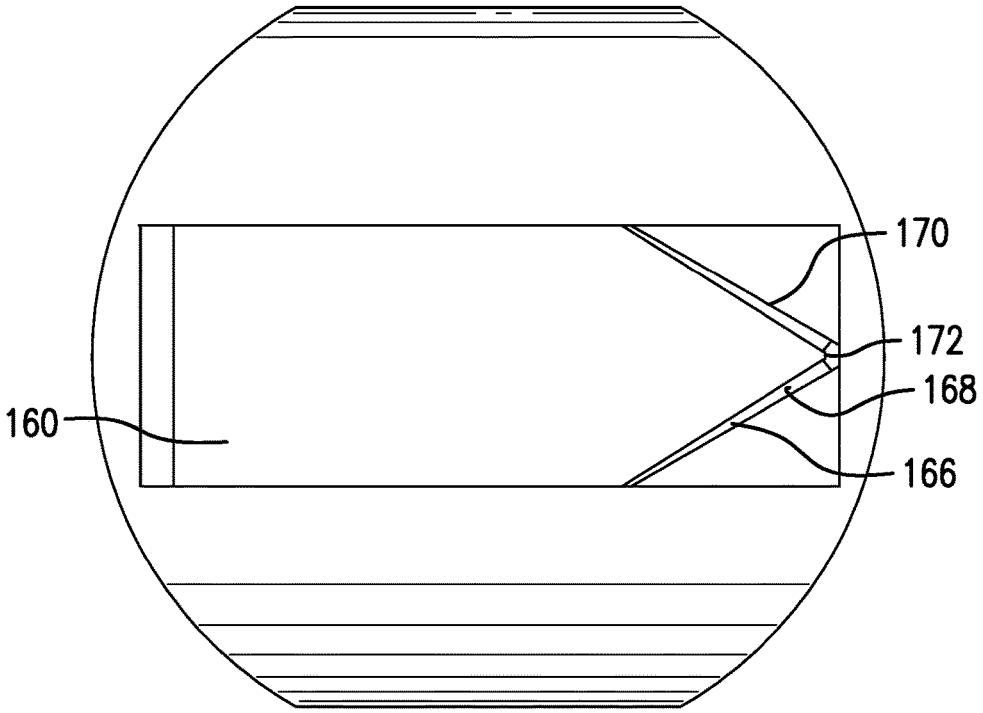
FIG. 17 depicts a plan view of the dog of FIGS. 14-16.

The above-described embodiments depict a collet 104 as an indicator housing with a helical member 124 provided on segments 114 (collet fingers) arrayed in such a way as to form a helical upset. Alternatively, as shown in FIGS. 14-17, a dog 160 and dog housing 162, serving as a movable member and an indicator housing, respectively, may be provided in lieu of the helical member 124 and collet 104. FIG. 14 depicts a run-in mode where the dog 160 is unsupported by support 164 of mandrel 24. In a pass-through mode, as shown in FIG. 15, the dog 160 is still unsupported by support 164 and may thus snap through the inner profile 142 of the outer tubular 12. In FIG. 16, the mandrel 24 is indexed (using indexing arrangement 46) to longitudinally align the support 164 with the dog 160 and block inward radial movement of the dog 160. As shown in FIG. 17, the dog 160 includes a side 166 having first and second helical side portions 168, 170 engageable with the helical profile face 150 as described with respect to FIGS. 10-13. The dog 160 thus serves as the helical member for the indicating tool 16. That is, depending on the rotational alignment of the dog 160 when it enters the inner profile 142, either the first side portion 168 will initially contact the first helical profile face section 152 and cam along the first helical profile face section 152 until an end 172 of the dog 160 lands on the intersection of the first and second helical profile face sections 152, 154 and the second side portion 170 additionally engages with the second helical profile face section 154; or, alternatively, the second side portion 170 will initially contact the second helical profile face section 154 and cam along the second helical profile face section 154 until the end 172 lands on the intersection of the first and second helical profile face sections 152, 154 and the first side portion 168 additionally engages with the first helical profile face section 152.

Figure 18:
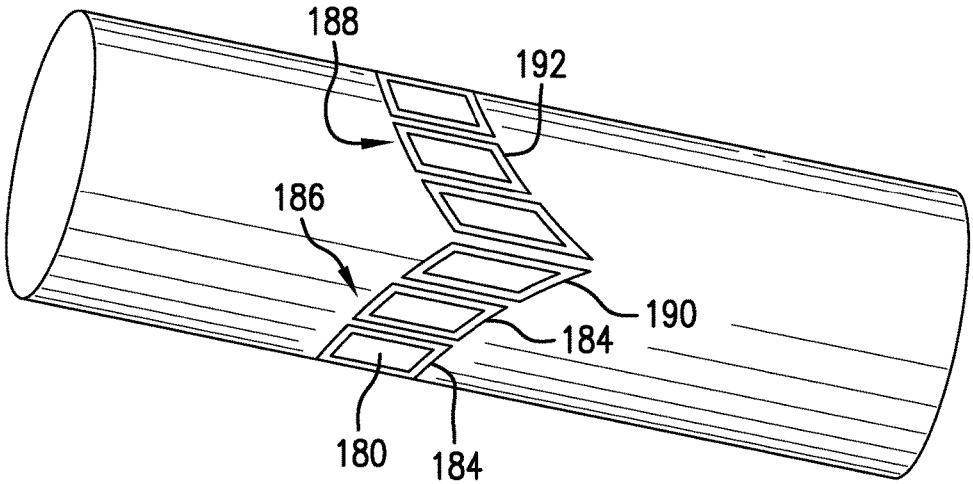
FIG. 18 depicts an embodiment of a dog housing and dogs for another embodiment of the indicating tool.

FIG. 18 shows another embodiment of the indicating tool 16 using dogs 180 and dog housing 182. Unless otherwise stated, features of the indicating tool 16 previously described within FIGS. 1-13 may be incorporated into the embodiment shown in FIG. 18. The dog housing 182 surrounds the mandrel 24, and in particular the second mandrel portion 28, as previously described. The dogs 180 are either supported by support 76 of mandrel 24 (FIG. 8), or collapsible radially inwardly into an annular space 136 (such as shown in FIGS. 5 and 6) between the mandrel 24 and the dog housing 182. The dog housing 182 includes a plurality of apertures 184 helically arranged with respect to each other. The helically arranged apertures 184 include a first set of apertures 186 and a second set of apertures 188 (not shown in their entirety), each set occupying a distinct radial section of the housing 182, whereas the first and second set of apertures 186, 188 extend within the same longitudinal section of the housing 182. The dogs 180 form first and second helical member portions, in particular a first helical dog set 190 and a second helical dog set 192. Thus, this embodiment works similar to the embodiment described above with respect to FIGS. 1-13 except that the helical nubs 134 of the collet 104 are replaced with helically arranged dogs 180. When indicating on the helical profile face 150 of the inner profile 142, the dogs 180 impart rotation to the tool 16 in a similar fashion as the helical member 124.

The embodiments described herein detail a system 10 used to rotationally align an inner string 14 to an outer tubular 12, to provide a positive no-go indication in the axial direction, and the ability to pass through each indication boundary in order to service multiple zones with rotationally aligning equipment. The embodiments of the tool 16 include an indexing arrangement 46 that controls when the tool 16 is in "indicate" mode, which prevents the tool from passing through a profile 142 in the outer tubular 12, and can be indexed to "pass through" mode, which allows the tool 16 to pass through profiles 142. The tool 16 is rotationally locked, in order to provide full rotation of the inner string 14 and of any rotationally fixed tools (such as a rotationally locked crossover tool) when the indicating tool 16 is located on a helical profile 142. The indicating feature of this system includes a helical collet 104 (or alternatively dogs 160, 180), in order to impart rotation into the tool 16 when interacting with a helical profile 142. The tool will make contact with the helical profile face 150 of the profile 142, rotate until fully aligned rotationally with the profile face 150, and either snap through or locate on the profile 142 depending on what mode the indexing arrangement 46 is in. The helical member (member 124, dog 160, or dogs 180) of the tool 16 is used to rotate into a mating helical profile 142, aligning the tool 16 to the helical profile 142 and outer tubular 12. The tool 16 can rotationally align with multiple helical profiles 142, dispersed at different longitudinal locations (such as in different zones) of the outer tubular 12, because the tool 16 is able to selectively locate on and pass through these profiles 142.

Thus the embodiments described herein provide a solution for rotationally aligning an inner string 14 to an outer tubular 12, as well as the ability to locate and snap through a mating profile 142 in order to rotationally align to multiple zones. Benefits of this ability would be targeted connection points for monitoring equipment at multiple points in the well. Also, for example, the tool 16, which is connectable to any units 18, 20 that can take advantage of being rotationally aligned, provides a solution to rotationally aligning a crossover tool to a frac sleeve, such as when the frac sleeve utilizes a ported and gun drilled sliding sleeve. For such an application, the frac port of the crossover tool would be rotationally aligned in order to ensure a flow path through the crossover tool and frac sleeve. Additionally, the locate and snap through ability of tool 16 allows for a crossover tool to be aligned to frac sleeves across multiple zones.

Embodiment 1

An indicating tool includes a mandrel including a support, an indicator housing surrounding the mandrel, and a member movable radially with respect to the housing. The mandrel is movable longitudinally with respect to the indicator housing, and the indicator housing is at least substantially rotationally locked with respect to the mandrel. The member is engageable with an inner profile of an outer tubular in which the indicating tool is employed, and the member has a substantially helical side. The member is movable radially inward towards the mandrel when the support is longitudinally displaced from the member, and the member is blocked from movement radially inwards when the support is longitudinally aligned with the member.

Embodiment 2

The indicating tool of embodiment 1, wherein the member protrudes outwardly from the indicator housing.

Embodiment 3

The indicating tool of embodiment 1, wherein the substantially helical side includes a plurality of spaced helical side portions.

Embodiment 4

The indicating tool of embodiment 1, wherein the support includes a helical shape.

Embodiment 5

The indicating tool of embodiment 1, wherein the indicator housing includes a collet, and the member includes a plurality of nubs of the collet, each nub including a portion of the substantially helical side.

Embodiment 6

The indicating tool of embodiment 5, wherein the collet includes a plurality of radially deflectable segments, each segment including a first end and a second end, the first and second ends attached to the housing, and each segment carrying one of the plurality of nubs between the first and second ends.

Embodiment 7

The indicating tool of embodiment 1, wherein the member includes at least one dog, the at least one dog including at least a portion of the substantially helical side.

Embodiment 8

The indicating tool of embodiment 7, wherein the indicator housing includes a plurality of openings arranged in a helical pattern, the at least one dog includes a plurality of dogs, and each opening in the plurality of openings is arranged to receive a respective one of the plurality of dogs there through.

Embodiment 9

The indicating tool of embodiment 1, wherein the mandrel includes a longitudinal keyway, and further comprising a key movable with the housing and within the keyway, wherein the key rotationally locks the housing with respect to the mandrel.

Embodiment 10

The indicating tool of embodiment 1, wherein the member has a first end and a second end, and the member includes a first helical member portion and a second helical member portion, the first helical member portion extending a half turn of a helix from the first end to the second end of the member in a clockwise direction with respect to a longitudinal axis of the indicating tool, and the second helical member portion extending a half turn of a helix from the first end to the second end of the member in a counterclockwise direction with respect to the longitudinal axis.

Embodiment 11

The indicating tool of embodiment 1, wherein an outer diameter of the tool at a radially outwardly facing surface of the member is greater than an outer diameter of the tool at an outer surface of the housing.

Embodiment 12

The indicating tool of embodiment 1, further comprising an indexing arrangement.

Embodiment 13

The indicating tool of embodiment 12, wherein the indexing arrangement includes an orientation sleeve surrounding the mandrel and having an indexing slot, an indexing housing surrounding the orientation sleeve, and a lug movable with the indexing housing and within the indexing slot, the mandrel movable longitudinally with respect to the indexing housing.

Embodiment 14

The indicating tool of embodiment 13, wherein the orientation sleeve is fixed with respect to the mandrel.

Embodiment 15

The indicating tool of embodiment 1, further comprising a spring surrounding the mandrel and biasing the support longitudinally away from the member.

Embodiment 16

A completion system includes an indicating tool and an outer tubular. The indicating tool includes a mandrel including a support, an indicator housing surrounding the mandrel, and a member movable radially with respect to the housing. The mandrel is movable longitudinally with respect to the indicator housing, and the indicator housing is at least substantially rotationally locked with respect to the mandrel. The member is engageable with an inner profile of an outer tubular in which the indicating tool is employed, and the member has a substantially helical side. The member is movable radially inward towards the mandrel when the support is longitudinally displaced from the member, and the member is blocked from movement radially inwards when the support is longitudinally aligned with the member. The inner profile of the outer tubular has a helical profile face.

Embodiment 17

The completion system of embodiment 16, wherein, when indicating tool is moved longitudinally with respect to the outer tubular, the side of the member engages with the helical profile face of the inner profile and the indicating tool moves rotationally with respect to the outer tubular.

Embodiment 18

A completion system includes an outer tubular having an inner profile, the inner profile having a helical profile face, and an indicating tool movable within the outer tubular. The indicating tool includes a mandrel including a support; an indicator housing surrounding the mandrel, the mandrel movable longitudinally with respect to the indicator housing, and the indicator housing at least substantially rotationally locked with respect to the mandrel; and a member movable radially with respect to the housing, the member engageable with the inner profile of the outer tubular, the member having a substantially helical side. Engagement of the side of the member with the helical profile face of the inner profile of the outer tubular imparts rotation to the indicating tool during longitudinal movement of the tool within the outer tubular.

Embodiment 19

The completion system of embodiment 18, wherein the member is movable radially inward towards the mandrel and the indicating tool is movable past the inner profile when the member is unsupported by the support, and the member is blocked from movement radially inwards and the indicating tool is set within the inner profile when the member is supported by the support.

Embodiment 20

The completion system of embodiment 18, further comprising a first unit connected to a first end of the mandrel, wherein movement of the helical side of the member along the helical profile face of the inner profile rotates the first unit with respect to the outer tubular.

Embodiment 21

A method of rotationally locating an inner string within an outer tubular, the method including running the inner string through the outer tubular towards an inner profile of the outer tubular, the inner string including an indicating tool, the indicating tool including a mandrel having a support, an indicator housing surrounding the mandrel, the mandrel movable longitudinally with respect to the indicator housing, the indicator housing at least substantially rotationally locked with respect to the mandrel, and a member movable radially with respect to the housing, the member having a substantially helical side; engaging the helical side of the member with the inner profile of the outer tubular; and, rotating the inner string with respect to the outer tubular by camming the helical side of the member along a helical profile face of the inner profile.

Embodiment 22

The method of embodiment 21, further comprising shifting the mandrel with respect to the indicator housing to at least substantially longitudinally align the support of the mandrel with the member.

Embodiment 23

The method of embodiment 22, further comprising, prior to shifting the mandrel to at least substantially longitudinally align the support of the mandrel with the member, pulling up on the inner string to index an indexing arrangement of the indicating tool to a pre-locate position.

Embodiment 24

The method of embodiment 21, further comprising, subsequent rotating the inner string with respect to the outer tubular, moving the inner string past the inner profile by moving the member radially inward towards the mandrel.

The use of the terms “a” and “an” and “the” and similar referents in the context of describing the invention (especially in the context of the following claims) are to be construed to cover both the singular and the plural, unless otherwise indicated herein or clearly contradicted by context. Further, it should further be noted that the terms “first,” “second,” and the like herein do not denote any order, quantity, or importance, but rather are used to distinguish one element from another. The modifier “about” used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. An indicating tool having a longitudinal axis and comprising:

a mandrel including a support, the support including a helical shape disposed helically around the longitudinal axis;

an indicator housing surrounding the mandrel, the mandrel movable longitudinally with respect to the indicator housing, and the indicator housing at least substantially rotationally locked with respect to the mandrel; and, a member movable radially with respect to the housing, the member engageable with an inner profile of an outer tubular in which the indicating tool is employed, the member having a substantially helical side disposed helically around the longitudinal axis;

wherein the member is movable radially inward towards the mandrel when the support is longitudinally displaced from the member, and the member is blocked from movement radially inwards when the support is longitudinally aligned with the member.

2. The indicating tool of claim 1, wherein the member protrudes outwardly from the indicator housing.

3. The indicating tool of claim 1, wherein the substantially helical side includes a plurality of spaced helical side portions disposed helically around the longitudinal axis.

4. The indicating tool of claim 1, wherein the indicator housing includes a collet, and the member includes a plurality of nubs of the collet, each nub including a portion of the substantially helical side, the nubs disposed helically around the longitudinal axis.

5. The indicating tool of claim 4, wherein the collet includes a plurality of radially deflectable segments, each segment including a first end and a second end, the first and second ends attached to the housing, and each segment carrying one of the plurality of nubs between the first and second ends.

6. The indicating tool of claim 1, wherein the member includes at least one dog, the at least one dog including at least a portion of the substantially helical side.

7. The indicating tool of claim 6, wherein the indicator housing includes a plurality of openings arranged in a helical pattern, the at least one dog includes a plurality of dogs, and each opening in the plurality of openings is arranged to receive a respective one of the plurality of dogs there through.

8. The indicating tool of claim 1, wherein the mandrel includes a longitudinal keyway, and further comprising a key movable with the housing and within the keyway, wherein the key rotationally locks the housing with respect to the mandrel.

9. The indicating tool of claim 1, wherein the member has a first end and a second end, and the member includes a first helical member portion and a second helical member portion, the first helical member portion extending a half turn of a helix from the first end to the second end of the member in a clockwise direction with respect to the longitudinal axis of the indicating tool, and the second helical member portion extending a half turn of a helix from the first end to the second end of the member in a counterclockwise direction with respect to the longitudinal axis.

10. The indicating tool of claim 1, wherein an outer diameter of the tool at a radially outwardly facing surface of the member is greater than an outer diameter of the tool at an outer surface of the housing.

11. The indicating tool of claim 1, further comprising an indexing arrangement.

12. An indicating tool having a longitudinal axis and comprising:

a mandrel including a support;

an indicator housing surrounding the mandrel, the mandrel movable longitudinally with respect to the indicator housing, and the indicator housing at least substantially rotationally locked with respect to the mandrel;

a member movable radially with respect to the housing, the member engageable with an inner profile of an outer tubular in which the indicating tool is employed, the member having a substantially helical side disposed helically around the longitudinal axis; and an indexing arrangement including an orientation sleeve surrounding the mandrel and having an indexing slot, an indexing housing surrounding the orientation sleeve, and a lug movable with the indexing housing and within the indexing slot, the mandrel movable longitudinally with respect to the indexing housing;

wherein the member is movable radially inward towards the mandrel when the support is longitudinally displaced from the member, and the member is blocked from movement radially inwards when the support is longitudinally aligned with the member.

13. The indicating tool of claim 12, wherein the orientation sleeve is fixed with respect to the mandrel.

14. An indicating tool having a longitudinal axis and comprising:

a mandrel including a support;

an indicator housing surrounding the mandrel, the mandrel movable longitudinally with respect to the indicator housing, and the indicator housing at least substantially rotationally locked with respect to the mandrel;

a member movable radially with respect to the housing, the member engageable with an inner profile of an outer tubular in which the indicating tool is employed, the member having a substantially helical side disposed helically around the longitudinal axis; and a spring surrounding the mandrel and biasing the support longitudinally away from the member;

wherein the member is movable radially inward towards the mandrel when the support is longitudinally displaced from the member, and the member is blocked from movement radially inwards when the support is longitudinally aligned with the member.

15. A completion system comprising:

the indicating tool of claim 1; and, the outer tubular, the inner profile of the outer tubular having a helical profile face.

16. The completion system of claim 15, wherein, when the indicating tool is moved longitudinally with respect to the outer tubular, the side of the member engages with the helical profile face of the inner profile and the indicating tool moves rotationally with respect to the outer tubular.

17. The completion system of claim 15, wherein engagement of the side of the member with the helical profile face of the inner profile of the outer tubular imparts rotation to the indicating tool during longitudinal movement of the tool within the outer tubular.

18. The completion system of claim 17, wherein the member is movable radially inward towards the mandrel and the indicating tool is movable past the inner profile when the member is unsupported by the support, and the member is blocked from movement radially inwards and the indicating tool is set within the inner profile when the member is supported by the support.

19. The completion system of claim 17, further comprising a first unit connected to a first end of the mandrel, wherein movement of the helical side of the member along the helical profile face of the inner profile rotates the first unit with respect to the outer tubular.

20. A method of rotationally locating an inner string within an outer tubular, the method comprising:

running the inner string through the outer tubular towards an inner profile of the outer tubular, the inner string including the indicating tool of claim 1;

engaging the helical side of the member with the inner profile of the outer tubular; and, rotating the inner string with respect to the outer tubular by camming the helical side of the member along a helical profile face of the inner profile.

21. The method of claim 20, further comprising shifting the mandrel with respect to the indicator housing to at least substantially longitudinally align the support of the mandrel with the member.

22. The method of claim 21, further comprising, prior to shifting the mandrel to at least substantially longitudinally align the support of the mandrel with the member, pulling up on the inner string to index an indexing arrangement of the indicating tool to a pre-locate position.

23. The method of claim 20, further comprising, subsequent to rotating the inner string with respect to the outer tubular, moving the inner string past the inner profile by moving the member radially inward towards the mandrel.

* * * * *